United States Patent [19]

Hetrick

[11] Patent Number: 4,580,280

[45] Date of Patent: Apr. 1, 1986

[54] PHOTOELECTRIC COUNTER WITH SUBSTANTIALLY UNITARY HOUSING

[75] Inventor: C. Douglas Hetrick, New Kensington, Pa.

[73] Assignee: Bobar Instruments, Inc., New Kensington, Pa.

[21] Appl. No.: 564,406

[22] Filed: Dec. 22, 1983

[51] Int. Cl.[4] ..... G06M 7/00

[52] U.S. Cl. ..... 377/6; 377/53; 235/98 C

[58] Field of Search ..... 377/53, 6; 235/98 C; D24/8; D14/116

[56] References Cited

U.S. PATENT DOCUMENTS

| | | | |
|---|---|---|---|
| 3,004,702 | 10/1961 | Kranz | 235/98 C |
| 3,581,067 | 5/1971 | Willits | 235/98 C |
| 4,242,574 | 12/1980 | Grant | 377/53 |
| 4,255,861 | 3/1981 | Nakata et al. | 377/53 |
| 4,396,828 | 8/1983 | Dino et al. | 377/53 |

*Primary Examiner*—John S. Heyman

*Assistant Examiner*—Karl Ohralik

*Attorney, Agent, or Firm*—Arnold B. Silverman

[57] ABSTRACT

A compact, unitary non-contacting counting device includes a housing with contains a photoelectric sensor adapted to monitor the passage of articles and emit responsive electrical signals and a totalizer for receiving such electrical signals or a related binary output change of state indication and maintaining a count. The housing is unitary and is sealed to resist undesired entry of foreign matter. The housing is preferably generally L-shaped having a first leg containing the photoelectric sensor which is adapted to emit and receive light in a first direction and a second leg which contains the totalizer which is adapted to display the count in the direction which may be opposed to or perpendicular to the second direction. Separate power supplies may be employed for the photoelectric sensor and the totalizer. Lenses or fiber optics may be employed to improve the efficiency of transmission of light from the source to the object or target and return of the light from the object or target.

15 Claims, 10 Drawing Figures

PHOTOELECTRIC COUNTER WITH SUBSTANTIALLY UNITARY HOUSING

BACKGROUND OF THE INVENTION

A. Field of the Invention

This invention relates to a non-contacting counting device which is adapted to provide a cumulative digital readout of the number of articles passing the counter.

B. Description of the Prior Art

It has been known for various purposes to employ counters in order to monitor manufacturing production quantities or the passage of articles such as on a conveyor belt, for example, by a given point.

Various types of contacting counters which maintain a cumulative count of the number of such articles passing an area have been known.

It has also been known to provide non-contacting detectors employing light means which impinge upon a target and are received as an indication which permits counting of the number of articles which have passed a given point.

One of the problems which has been experienced with prior art devices is the need to mount the optical portion of a non-contacting device closely adjacent to the conveyor means, to mount the separate counter mechanism in a different location and to connect the same with appropriate power and signal carrying wires. Such installations have not only been awkward, but also have involved the disadvantages of exposing at least portions of the system to moisture, dust, oil and other potentially corrosive or otherwise destructive materials.

There remains, therefore, a very real and substantial need for an effective non-contacting counting device which is easy to install and resists adverse effects of the immediate environment.

SUMMARY OF THE INVENTION

The present invention has met the above-described need. A housing member, which is preferably unitary, contains photoelectric sensing means for monitoring the passage of articles thereby and effecting a responsive binary output change of state and totalizer means operatively associated with the photoelectric sensing means for maintaining a count of the number of such articles passing a given point. The housing contains both the photoelectric sensing means and the totalizer means and is sealed so as to resist undesired entry of foreign matter. Lens means or fiber optic means may be employed in the photoelectric sensing means to facilitate improved efficiency of the transfer of light to and from the object or other target.

The housing may have a generally L-shaped configuration with the photoelectric sensing means sending and receiving light in a first direction with respect to the housing and the totalizer means providing a visual display of the count in a second direction different from the first direction which may, for example, be generally opposite to or perpendicular with respect to the first direction. Effective seal means may be positioned between the legs of the generally L-shaped housing so as to resist undesired entry of foreign matter such as water, moisture, oil, dust or other materials.

It is an object of the present invention to provide a non-contacting counting device in a unitary housing which is sealed to resist the undesired entry of foreign matter.

It is a further object of the invention to provide such a system which is adapted for proximity or reflex monitoring of passing objects and may be mounted for efficient use of the photoelectric sensing means while permitting ready access to the cumulative count.

It is a further object of the invention to provide such a counting device which permits retention of the count even with loss of power and resetting of the count either at the counter or remotely therefrom.

It is a further object of the invention to provide a counter which may be employed in environments which have high temperatures and/or substantial vibrations.

It is a further object of the invention to provide such a counter which is compact, light weight and economical to purchase and use and will accurately and silently accumulate the count.

These and other objects of the invention will be more fully understood from the following description of the invention on reference to the illustrations appended hereto.

DESCRIPTION OF THE PREFERRED EMBODIMENTS

Figure 1:
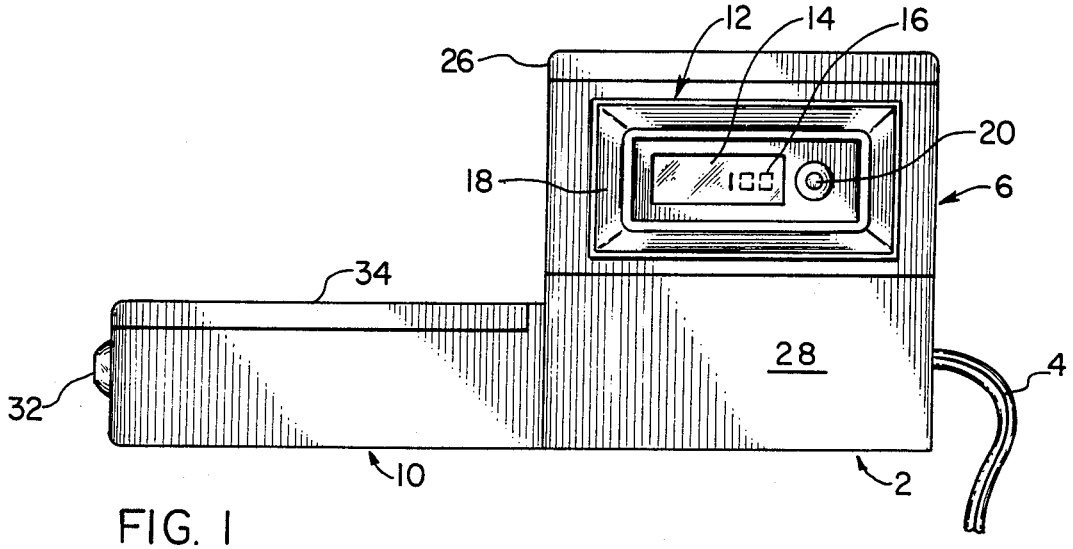
FIG. 1 is a front elevational view of a form of counter of the present invention.

Referring now more specifically to FIGS. 1 through 6, a preferred form of photoelectric counter of the present invention will be described in detail. As is shown, the housing is assembled from components so as to provide a unitary construction. Power is delivered to the photoelectric sensing means through wire 4 which may conveniently be connected by a plug or other means to a suitable power supply such as a 115 or 230 volt AC source or a DC source, for example. In a preferred form of this embodiment, the housing 2 is of generally L-shaped and has a first leg 6 within which the totalizer means 12 are provided and a second leg 10 within which the photoelectric sensing means are provided. As is shown in FIG. 1, the totalizer means which is disposed within leg 6 of the housing 2 has a frame portion 18 which surrounds a display window 14 which contains a count 16. The count, for purposes of illustration has been shown as being "100". A reset button 20 is also provided in order to permit manual resetting of the count to zero or another predetermined number at the unit. If desired, a remote controlled reset member may be provided in addition to or in lieu of reset button 20.

Leg 6 is provided with a suitable removable cover plate 26 to permit free access to the totalizer means 12.

Figure 3:
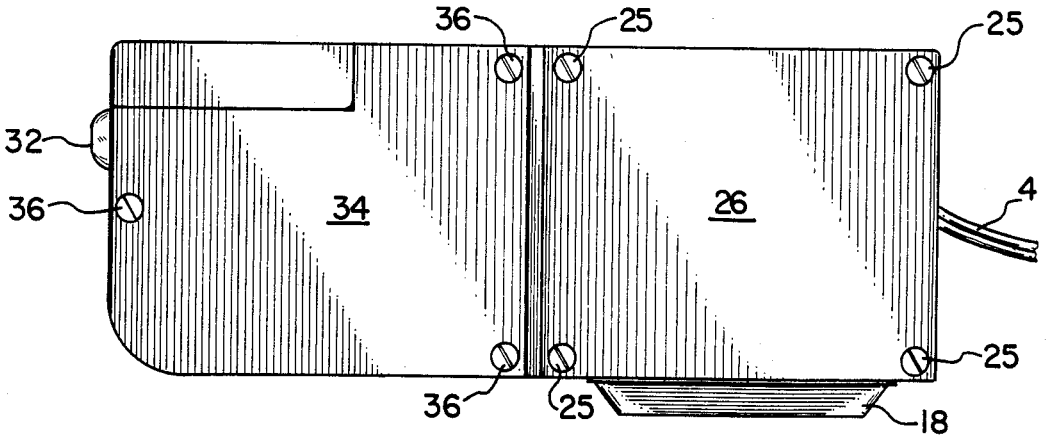
FIG. 3 is a top plan view of the counter shown in FIG. 1.

One of the advantageous features of the present invention is the characteristic of the housing 2 which enables it to be waterproof, dustproof and oil tight. In a preferred embodiment of the invention, generally sheet-like gaskets which may be composed of resiliently compressible rubber and have central openings are provided between the cover plate 26 and the remainder of leg 6 and also between leg 6 and housing section 28. As is shown in FIG. 3, a series of screws 25 may be tightened in order to secure the assembly and compress the gaskets.

Figure 2:
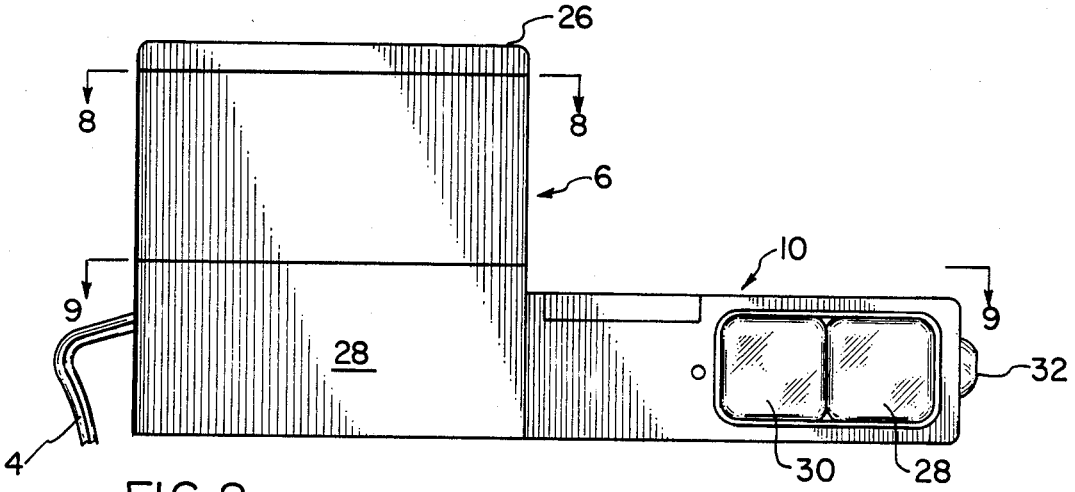
FIG. 2 is a rear elevational view of the counter shown in FIG. 1.

With particular emphasis on FIG. 2, it is noted that a pair of lenses 28, 30 are provided in leg 10. In order to facilitate convenience of reading the count 16, these lenses 28, 30 preferably face in a first direction and the count 16 is so oriented as to be in a second direction which may advantageously be either opposite to or perpendicular to the first direction. The former form is illustrated.

One of the lenses, which will be assumed to be 28 for purposes of disclosure, cooperates with a suitable light source which will be described in greater detail hereinafter contained within the photoelectric sensing means. By energizing the light source which in conjunction with lens 28 causes the light to impinge on the desired target, operation of the system is initiated. The other lens 30 is adapted to receive the reflected light and focus it on a tuned light receiver which is also disposed within the photoelectric sensing means. In monitoring the passage of articles such as containers on a moving conveyor, for example, several approaches may be taken. The counter may be used as a proximity device wherein the light passing through lens 28 is reflected off of the moving object and received through lens 30. An alternate approach is to employ a reflex approach wherein a reflective target is positioned on the opposite side of the path of travel of the article or articles moving by the counter. Light from lens 28 is reflected in a generally parallel path to lens 30 by the reflective target. Objects interrupting this reflex light beam will initiate action by the system.

In operation, modulated light emerges from lens 28 and will be reflected to be received in lens 30. Upon receipt of the reflected light, the tuned light receiver will convert the received light into an electrical pulse corresponding to a predetermined increment in the count maintained by the totalizer means 12. In addition to being able to employ the counter in either a proximity or reflex mode, the photoelectric sensing means is preferably such as to be set to record either the receipt of reflected light as an element advancing the count or the darkness between successive reflections of light as advancing the count.

Referring still to FIGS. 1 through 6, an indicator light 32 is mounted on the exterior of the housing and provides an indication as to whether the counter is sensing an object or not.

Figure 4:
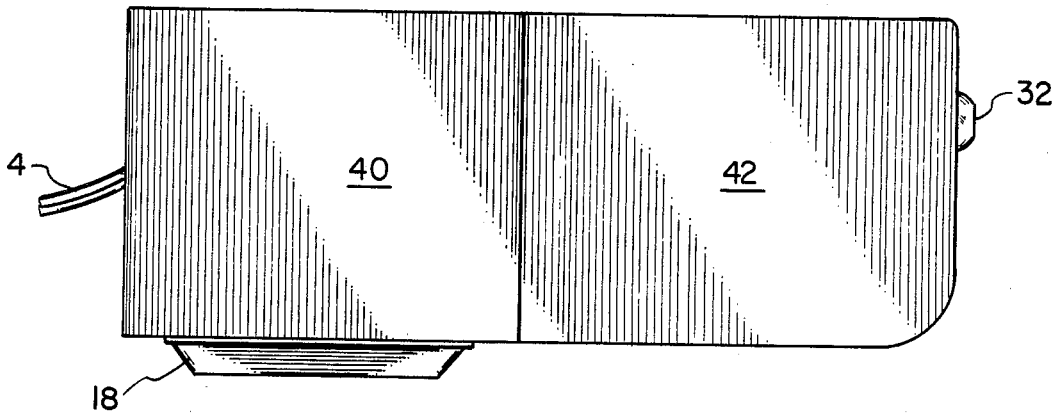
FIG. 4 is a bottom plan view of the counter shown in FIG. 1.

Cover plate 34 covers leg 10 and preferably has a gasket which may be a resiliently compressible rubber member underlying the same and secured in compressed relationship by a series of screws 36. Base walls 40, 42 are shown in FIG. 4.

Figure 5:
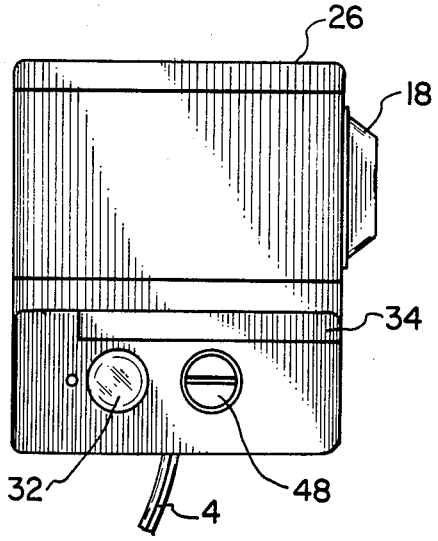
FIG. 5 is a right side elevational view of the counter shown in FIG. 1.
Figure 6:
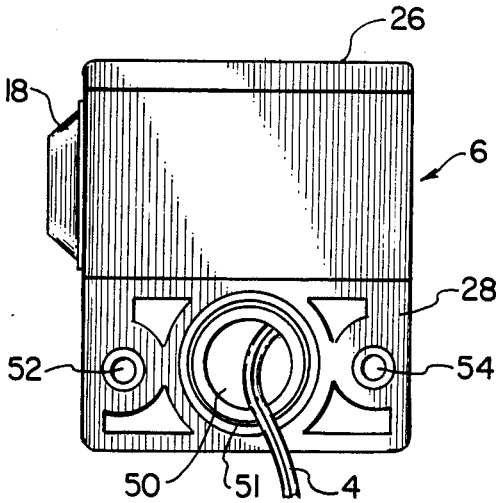
FIG. 6 is a left side elevational view of the counter shown in FIG. 1.

Attachment screw 48, shown in FIG. 5, is adapted to secure leg 10 which contains the photoelectric means to the housing 2 thereby enabling ready field replacement thereof without disturbing the mounting or totalizer means. Opening 50 is preferably defined by annular wall 51 which is internally threaded in order to receive an electrical coupling member. Bores 52, 54 are preferably internally threaded in order to facilitate securement of the counter to a piece of equipment or other suitable support.

Figure 7:
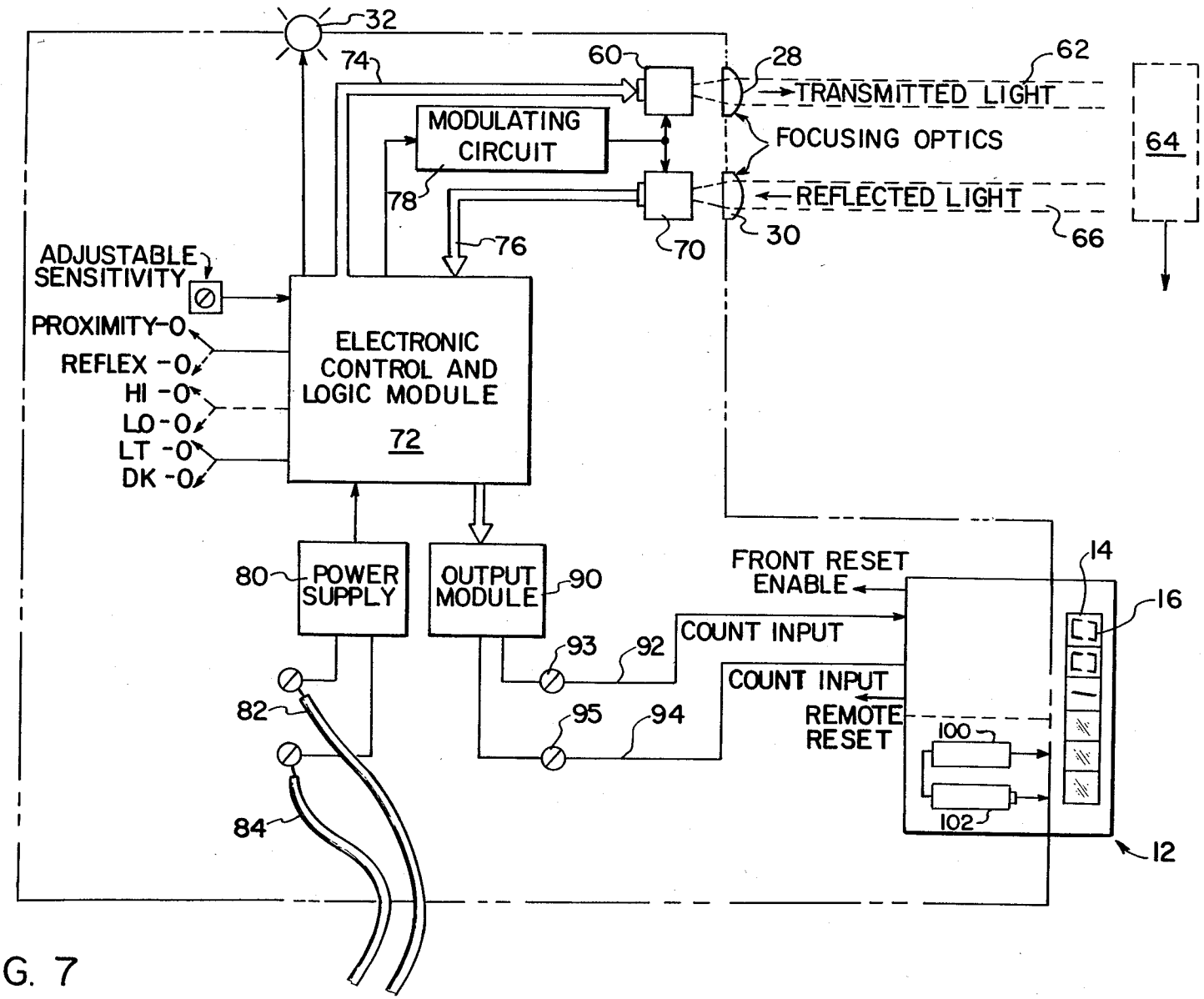
FIG. 7 is a partially schematic circuit diagram of the counter shown in FIG. 1.

Referring now to FIG. 7, a schematic circuit diagram showing the manner in which the counter of the present invention operates will be considered. The dotted border represents the housing in schematic fashion. Light source 60 which is preferably a light emitting diode (LED) source emits a beam of light 62 which through lens 28 is focused on a target 64 which is moving in the direction indicated by the arrow in use of the system in a proximity mode. The LED may be pulsed at a rate of about 4000 Hz. (Were the reflex mode to be employed, the light beam 62 would impinge on a reflective target (not shown) disposed to the right of moving object 64 as shown in FIG. 7 and would be reflected back through lens 30 with the continuity of the reflected beam being interrupted by moving object 64.) Referring now to illustrated proximity mode, the light beam 62 will impinge on the moving target 64 and will be reflected as beam 66. Beam 66 will pass through lens 30 and be received by tuned light receiver 70 wherein the receipt of the pulsed reflected light beam will be an event which results in the responsive electrical signal 76 being emitted. This will result in a change of state of a relay in the module 72 or output module 90 thereby altering the count in totalizer means 12. Alternately, the totalizer means may be made directly or indirectly to be responsive to the electrical signal by other means.

It will be appreciated that electronic control and logic module, which may be of any known form suitable for accomplishing the desired objectives, serves to energize the line 74 to the LED light source 60, serves to energize the modulating circuit 78 which coordinates pulsing of the light beam. The arrows from the modulating circuit 78 to the LED light source 60 and tuned light receiver 70 are symbolic of these two elements being synchronized by being modulated by circuit 78 and serves to receive the electrical signal corresponding to the reflected beam being received. The module 72 also energizes the indicator light 32 to show that the system is sensing an object. The module 72 is provided with an adjustable sensitivity control which makes the control suitable for a range of applications involving differing materials and/or detecting distances. Module 72 also contains a switch which permits the counter to function either in a proximity or reflex mode. Further, the control switch indicated as "hi" and "lo" provides means for selecting a gross range over which the adjustable sensitivity control is effective. The light dark switch permits the device to function either by recording the presence of reflected light as an event to trigger an increase in the count or, in the alternative, the absence of reflected light as an event to trigger a count. Power supply 80 may conveniently be of the said state reduced voltage type and be energized by wires 82, 84.

An output module 90 which serves to amplify logic produced by module 72 so as to provide a recognizable binary output change of state is interposed between the electronic control and logic module 72 and the totalizer means 12. The count is delivered to the totalizer means 12 through lines 92 and 94. The terminals 93, 95 in their respective lines 92, 94 serve to connect the wires. The totalizer means 12 is preferably energized by battery means 100, 102 as this permits the count to be maintained regardless of possible interruption in power provided through power supply 80.

Also shown in FIG. 7 are the front reset and remote reset means which may be provided. Also, if desired, a built-in alarm, such as that sold under the trade designation Sonalert, may be employed in order to emit an audible sound when a predetermined count has been reached.

Figure 8:
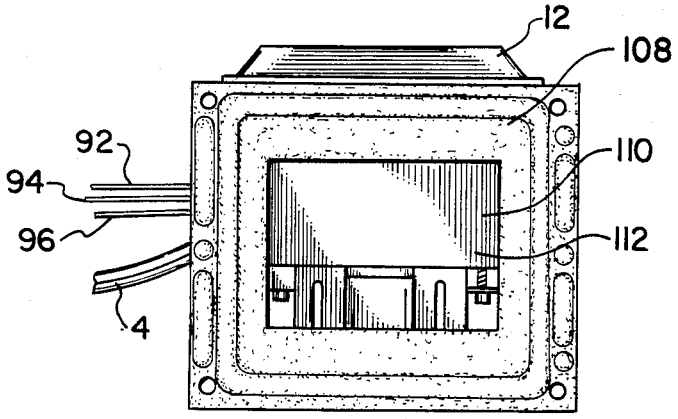
FIG. 8 is a cross sectional illustration of a portion of the counter taken through 8—8 of FIG. 2.
Figure 9:
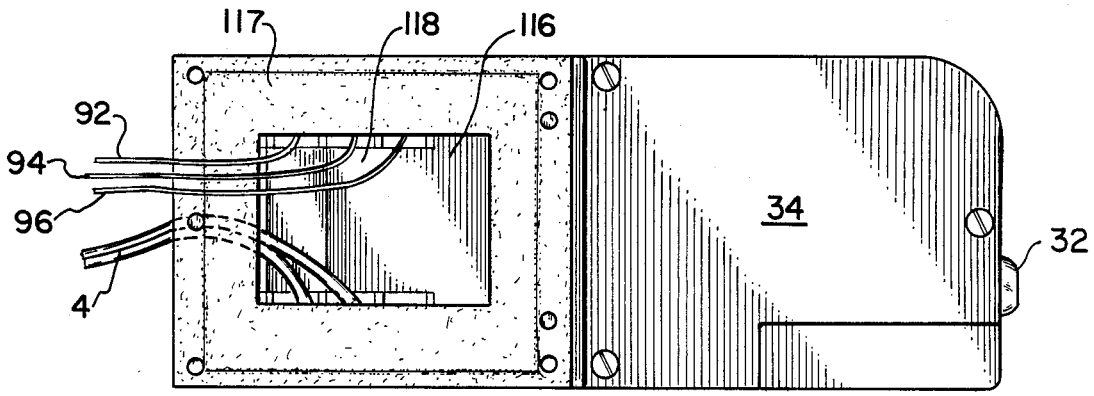
FIG. 9 is a view of the counter taken partly in section through 9—9 of FIG. 2.

Referring to FIGS. 8 and 9, portions of the legs 6, 10 will be considered in greater detail. As is shown in FIG. 8, the totalizer 12 has the exterior display and an interior housing 112 disposed within space 110 defined by hollow leg 6. A gasket member 100, which in the form shown is composed of a resiliently compressible material and has a generally rectangular exterior peripheral configuration and defines a rectangular opening is adapted to be interposed between the leg portion which houses the totalizer means and the overlying cover member 26. Similarly, as is shown in FIG. 9, the photoelectric sensing means has an internal housing 116 and a gasket 117 which may be generally of the same type as that shown in FIG. 8, but may be of a different size with the gasket being represented by the number 117 and the opening defined by the gasket by the number 118. It will be appreciated that openings 110, 118 permit wires 92, 94, 96 to pass between the totalizer housing 112 and the photoelectric sensing means housing 116 while preserving the seal on housing 112 to thereby resist undesired entry of water, moisture, dust, oil and other foreign matter into the interior of the housing.

A suitable gasket of the general type as gaskets 108, 117 is interposed between main housing section 2 and leg 10.

Figure 10:
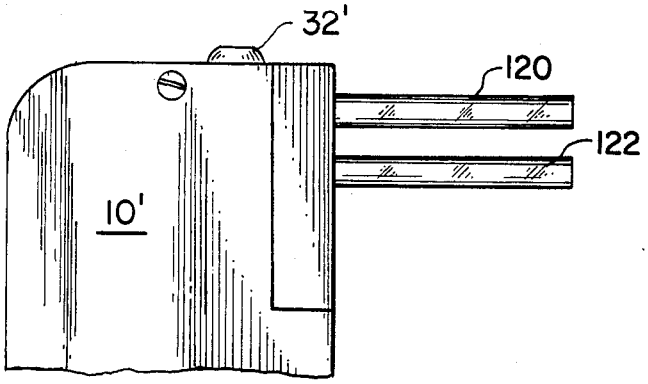
FIG. 10 is a fragmentary partial illustration of a modified form of the present invention.

Referring to FIG. 10, a further embodiment of the invention will be considered. In this embodiment, leg 10' rather than relying on lenses such as lenses 28, 30 to transfer light from the light source to the target and from the target to the receiver, employs a pair of elongated fiber optic members 120, 122 which project outwardly from the housing 2 and may be of any desired cross-sectional shape, such as circular, for example. These fiber optic members 120, 122 may be made as separate members or may be combined in a unitary structure with different channels or fibers being used for transfer of light in each direction.

It will be appreciated, therefore, that the present invention provides a unique photoelectric counter wherein a compact unit which is effectively sealed to resist undesired entry of foreign matter and is uniquely configurated for efficiency of use of both the photoelectric sensing means and the digital counter readout is provided. The device may readily be attached to equipment or other convenient support members adjacent to the path to be monitored while providing ease of access to the count. All of this is accomplished in an economical manner.

While for purposes of example specific reference has been made to counting articles while passing the counter on a conveyor, it will be appreciated that the invention is not so limited. Numerous other uses will be apparent to those skilled in the art. For example, pieces of raw material dropping into processing or handling equipment could be monitored.

Whereas particular embodiments of the invention have been described above for purposes of illustration, it will be evident to those skilled in the art that numerous variations of the details may be made without departing from the invention as defined in the appended claims.

I claim:

1. A photoelectric counter comprising a substantially unitary housing, photoelectric sensing means for monitoring the passage of articles thereby and emitting responsive electrical signals, totalizer means operatively associated with said photoelectric sensing means for maintaining a count of the number of said articles passing said photoelectric sensing means, said housing containing said photoelectric sensing means and said totalizer means, said housing being sealed to resist undesired entry of foreign matter, said housing having a first section within which a photoelectric sensing means is disposed and a second section within which said totalizer means is contained, and seal means including gasket means interposed between said first and second housing sections.

2. The photoelectric counter of claim 1 including wire means connecting said photoelectric sensing means and said totalizer means, and said wire means passing through openings in said gasket means.

3. The photoelectric counter of claim 1 including relay means interposed between said photoelectric sensing means and said totalizer means for effecting a binary output change of state responsive to said electrical signals.

4. The photoelectric counter of claim 2 including reset means operatively associated with said totalizer means for resetting the count to a predetermined level.

5. The photoelectric counter of claim 4 including said reset means being in communication with the exterior of said housing.

6. The photoelectric counter of claim 1 including said photoelectric sensing means having light source means and light receiving means both facing in a first direction with respect to said housing, said totalizer means providing a visual indication of said count readable from a second direction with respect to said housing, and said second direction being generally opposed or generally perpendicular with respect to said first direction, whereby one monitoring the count may be positioned on the opposite side of said housing from the objects being counted.

7. The photoelectric counter of claim 6 including said light source means including an LED source.

8. The photoelectric counter of claim 7 including first lens means operatively associated with said light source means, and second lens means operatively associated with said light receiver means.

9. The photoelectric counter of claim 6 including fiber optic means operatively associated with said light source means and said light receiving means.

10. The photoelectric counter of claim 4 including said reset means being disposed remotely from said housing.

11. The photoelectric counter of claim 4 including first power means for energizing said photoelectric sensing means, and second power means for energizing said totalizer means.

12. The photoelectric counter of claim 11 including said second power means including battery means.

13. The photoelectric counter of claim 6 including said housing being generally L-shaped, a first leg of said housing containing said photoelectric sensing means, and a second leg of said housing containing said totalizer means.

14. The photoelectric counter of claim 13 including indicator light means secured to said housing for providing a visual indication of whether said counter is sensing an object or not.

15. The photoelectric counter of claim 1, wherein said counter is employed in environments which have high temperatures or substantial vibrations.

* * * * *